US008926816B2

(12) United States Patent
Nordberg

(10) Patent No.: US 8,926,816 B2
(45) Date of Patent: Jan. 6, 2015

(54) SYSTEMS AND METHODS TO ANALYZE MATERIALS OF A SUSPENSION BY MEANS OF DIELECTROPHORESIS

(75) Inventor: Joshua John Nordberg, Bainbridge Island, WA (US)

(73) Assignee: Rarecyte, Inc., Seattle, WA (US)

( * ) Notice: Subject to any disclaimer, the term of this patent is extended or adjusted under 35 U.S.C. 154(b) by 367 days.

(21) Appl. No.: 13/432,629

(22) Filed: Mar. 28, 2012

(65) Prior Publication Data

US 2013/0112560 A1 May 9, 2013

Related U.S. Application Data

(60) Provisional application No. 61/556,888, filed on Nov. 8, 2011.

(51) Int. Cl.
*B03C 5/02* (2006.01)
*B03C 5/00* (2006.01)

(52) U.S. Cl.
CPC ..... *B03C 5/005* (2013.01); *B03C 5/024* (2013.01); *B03C 2201/18* (2013.01); *B03C 2201/26* (2013.01)
USPC ..... 204/547; 137/13; 137/806; 417/48

(58) Field of Classification Search
CPC ..... G01N 35/0098; B01L 3/5025; B01L 3/50215; B01L 3/502753; B03C 5/00–5/028; B03C 2201/00–2201/32; B01D 2247/02
USPC ..... 204/520, 547, 630, 643; 422/527, 500; 210/513, 516, 518, 787
See application file for complete search history.

(56) References Cited

U.S. PATENT DOCUMENTS

| | | | | |
|---|---|---|---|---|
| 4,834,861 | A | 5/1989 | Inoue | |
| 5,879,828 | A | 3/1999 | Debe et al. | |
| 6,116,257 | A * | 9/2000 | Yokota et al. | 137/1 |
| 6,374,909 | B1 | 4/2002 | Jeter et al. | |
| 7,074,577 | B2 * | 7/2006 | Haubert et al. | 435/7.24 |
| 7,153,648 | B2 | 12/2006 | Jing et al. | |
| 7,686,934 | B2 | 3/2010 | Hodko et al. | |
| 8,034,226 | B2 | 10/2011 | Pham et al. | |
| 2002/0155586 | A1 | 10/2002 | Cheng et al. | |
| 2006/0219556 | A1 * | 10/2006 | Ivory et al. | 204/450 |
| 2006/0260944 | A1 | 11/2006 | Madou et al. | |

FOREIGN PATENT DOCUMENTS

WO 2011050366 A2 4/2011

* cited by examiner

*Primary Examiner* — J. Christopher Ball
(74) *Attorney, Agent, or Firm* — Olympic Patent Works PLLC

(57) ABSTRACT

Systems and methods for trapping and moving individual particles of a target material of a suspension are disclosed. In one aspect, a system includes a tube and an electronically addressable float. The float includes one or more arrays of electrodes in which each electrode can be independently addressed to create non-uniform electric fields that trap and isolate target particles near the float. The electrodes can be dynamically operated to move the target particles to particular locations on the float for analysis and collection.

20 Claims, 15 Drawing Sheets

SYSTEMS AND METHODS TO ANALYZE MATERIALS OF A SUSPENSION BY MEANS OF DIELECTROPHORESIS

CROSS-REFERENCE TO RELATED APPLICATION

This application claims the benefit of Provisional Application No. 61/556,888, filed Nov. 8, 2011.

TECHNICAL FIELD

This disclosure relates generally to density-based fluid separation and, in particular, to tube and float systems for the separation and axial expansion of constituent suspension components layered by centrifugation.

BACKGROUND

Suspensions often include materials of interests that are difficult to detect, extract and isolate for analysis. For instance, whole blood is a suspension of materials in a fluid. The materials include billions of red and white blood cells and platelets in a proteinaceous fluid called plasma. Whole blood is routinely examined for the presence of abnormal organisms or cells, such as ova, fetal cells, endothelial cells, parasites, bacteria, and inflammatory cells, and viruses, including HIV, cytomegalovirus, hepatitis C virus, and Epstein-Barr virus. Currently, practitioners, researchers, and those working with blood samples try to separate, isolate, and extract certain components of a peripheral blood sample for examination. Typical techniques used to analyze a blood sample include the steps of smearing a film of blood on a slide and staining the film in a way that enables certain components to be examined by bright field microscopy.

On the other hand, materials of interest composed of particles that occur in very low numbers are especially difficult if not impossible to detect and analyze using many existing techniques. Consider, for instance, circulating tumor cells ("CTCs"), which are cancer cells that have detached from a tumor, circulate in the bloodstream, and may be regarded as seeds for subsequent growth of additional tumors (i.e., metastasis) in different tissues. The ability to accurately detect and analyze CTCs is of particular interest to oncologists and cancer researchers, but CTCs occur in very low numbers in peripheral whole blood samples. For instance, a 7.5 ml sample of peripheral whole blood that contains as few as 5 CTCs is considered clinically relevant in the diagnosis and treatment of a cancer patient. However, detecting even 1 CTC in a 7.5 ml blood sample is equivalent to detecting 1 CTC in a background of about 40 billion red and white blood cells. Using existing techniques to find, isolate and extract as few as 5 CTCs of a whole blood sample is extremely time consuming, costly and may be impossible to accomplish. As a result, practitioners, researchers, and those working with suspensions continue to seek systems and methods to more efficiently and accurately detect, isolate and extract target materials of a suspension.

SUMMARY

Systems and methods for trapping and moving individual particles of a target material of a suspension are disclosed. In one aspect, a system includes a tube and an electronically addressable float. The float includes one or more arrays of electrodes in which each electrode can be independently addressed to create non-uniform electric fields that trap and isolate target particles near the float. The electrodes can be dynamically operated to move the target particles to particular locations on the float for analysis and collection.

DETAILED DESCRIPTION

Systems and methods for trapping and moving individual particles of a target material of a suspension are disclosed. The systems include a tube and an electronically addressable float. The float includes arrays of electrodes that can be individually operated to create non-uniform electric fields that trap particles of a target material for analysis and collection. The electrodes provide higher efficiency of individual target particle analysis because individual target particles can be isolated and collected without having to use chemical fixation to attach the target particles to the outer surface of the float. Because the float can be operated to trap individual target particles, other materials not held in place by the float can be washed away, which enables easier access to the target particles for analysis and collection.

The detailed description is organized into three subsections: (1) A general description of tube and float systems is provided in a first subsection. (2) Examples of electronically addressable floats are provided in a second subsection. (3) Methods for using tube and electronically addressable float systems to trap and isolate target materials of a suspension are provided in a third subsection.

General Description of Tube and Float Systems

Figure 1A:
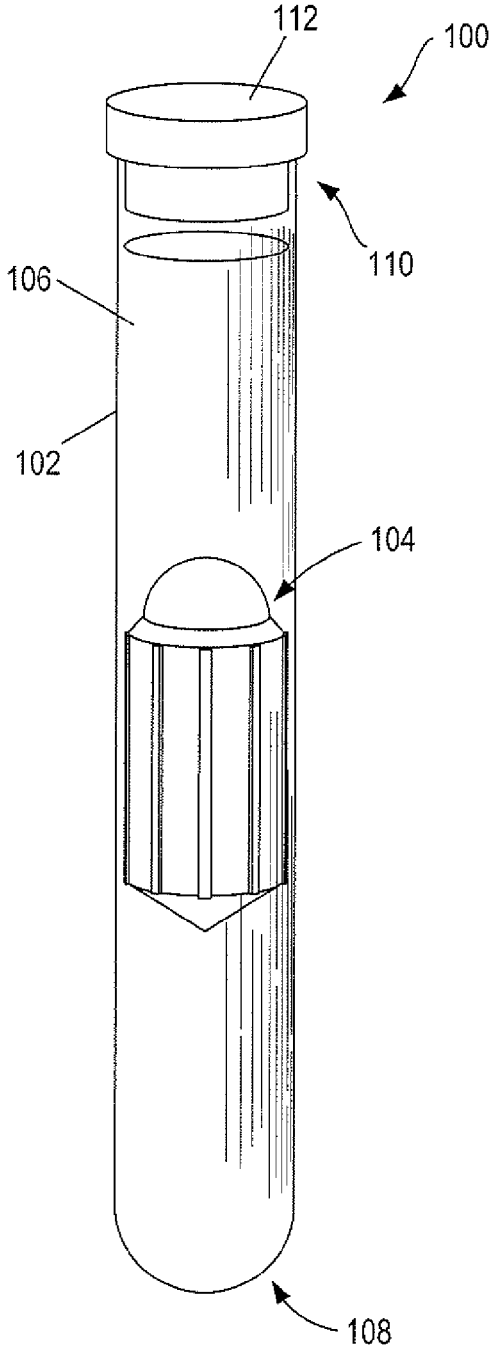
FIGS. 1A-1B show isometric views of two example tube and float systems.
Figure 1B:
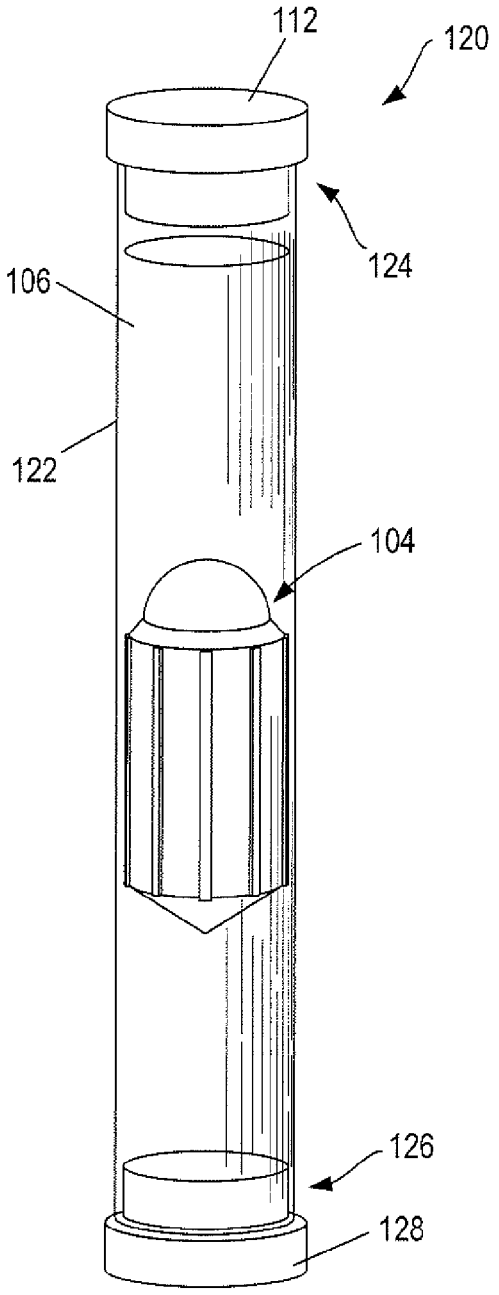

FIG. 1A shows an isometric view of an example tube and float system 100. The system 100 includes a tube 102 and a programmable float 104 suspended within a suspension 106. In the example of FIG. 1A, the tube 102 has a circular cross-section, a first closed end 108, and a second open end 110. The open end 110 is sized to receive a stopper or cap 112. A tube may also have two open ends that are sized to receive stoppers or caps, such as the tube 122 of an example tube and float system 120 shown FIG. 1B. The system 120 is similar to the system 100 except the tube 102 of the system 102 is replaced by a tube 122 that includes two open ends 124 and 126 configured to receive the cap 112 and a cap 128, respectively. The tubes 102 and 122 have a generally cylindrical geometry, but may also have a tapered geometry that widens toward the open ends 110 and 124, respectively. Although the tubes 102 and 122 have a circular cross-section, in other embodiments, the tubes 102 and 122 can have elliptical, square, triangular, rectangular, octagonal, or any other suitable cross-sectional shape that substantially extends the length of the tube. The tubes 102 and 122 can be composed of a transparent or semi-transparent flexible material, such as flexible plastic or another suitable material.

Figure 2A:
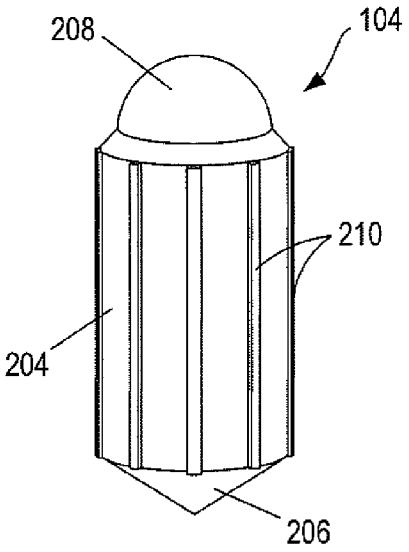
FIGS. 2A-2D show four floats with examples of different structural elements.
Figure 2B:
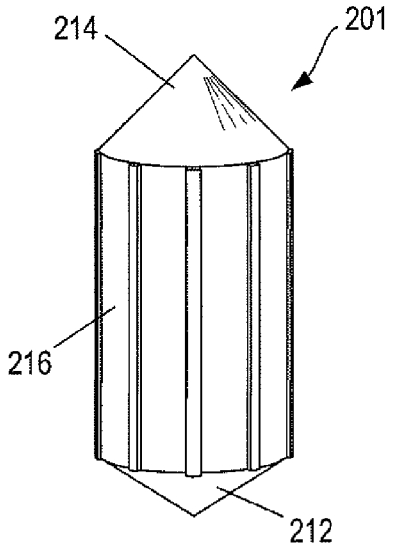
Figure 2C:
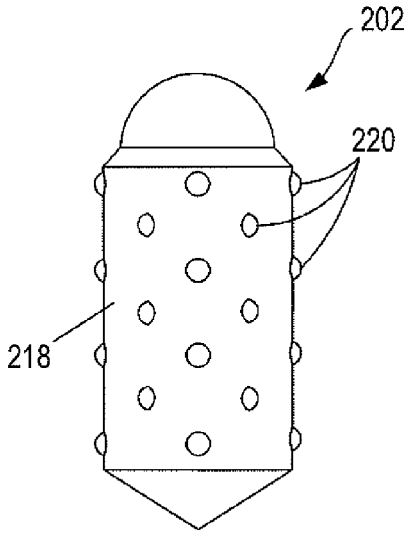
Figure 2D:
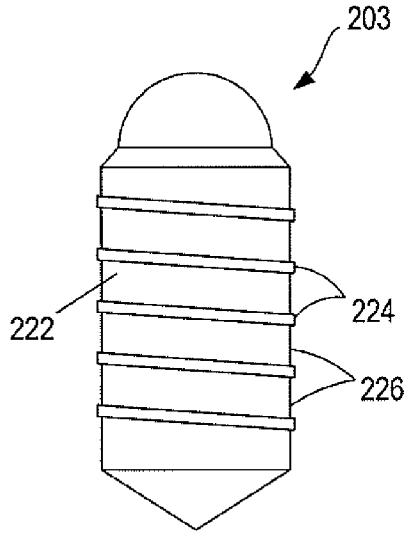

FIGS. 2A-2D shows four examples of floats 104 and 201-203 with different types of structural elements and end caps. In FIG. 2A, the float 104, shown in FIG. 1, includes a main body 204, a cone-shaped end cap 206, a dome-shaped end cap 208, and structural elements in the form of splines 210 that are radially spaced and axially oriented. The splines 210 provide a sealing engagement with the inner wall of the tube 102. In other embodiments, the number of splines, spline spacing, and spline thickness can be independently varied. The splines 210 can also be broken or segmented. The main body 204 is sized to have an outer diameter that is less than the inner diameter of the tube 102, thereby defining fluid retention channels between the outer surface of the body 204 and the inner wall of the tube 102. The outer surfaces of the body 204 between the splines 210 can be flat, curved or have another suitable geometry. In the example of FIG. 2A, the splines 210 and the body 204 form a single structure. Embodiments include other types of geometric shapes for float end caps. In FIG. 2B, an example float 201 has two cone-shaped end caps 212 and 214. The main body 216 of the float 201 includes the same structural elements (i.e., splines) as the float 104. A float can also include two dome-shaped end caps. Float end caps can be configured with other geometric shapes and are not intended to be limited to the shapes described herein. In other embodiments, the main body of a float can include a variety of different structural elements for separating target materials, supporting the tube wall, or directing the suspension fluid around the float during centrifugation. FIGS. 2C and 2D show examples of two different types of main body structural elements. Embodiments are not intended to be limited to these two examples. In FIG. 2C, the main body 218 of the float 202 is similar to the float 104 except the main body 218 includes a number of protrusions 220 that provide support for the deformable tube. In other embodiments, the number and pattern of protrusions can be varied. In FIG. 2D, the main body 222 of the float 203 includes a single continuous helical structure or ridge 224 that spirals around the main body 222 creating a helical channel 226. In other embodiments, the helical ridge 224 can be rounded or broken or segmented to allow fluid to flow between adjacent turns of the helical ridge 224. In other embodiments, the helical ridge spacing and rib thickness can be independently varied.

A float can be composed of a variety of different materials including, but are not limited to, rigid organic or inorganic materials, and rigid plastic materials, such as polyoxymethylene ("Delrin®"), polystyrene, acrylonitrile butadiene styrene ("ABS") copolymers, aromatic polycarbonates, aromatic polyesters, carboxymethylcellulose, ethyl cellulose, ethylene vinyl acetate copolymers, nylon, polyacetals, polyacetates, polyacrylonitrile and other nitrile resins, polyacrylonitrile-vinyl chloride copolymer, polyamides, aromatic polyamides ("aramids"), polyamide-imide, polyarylates, polyarylene oxides, polyarylene sulfides, polyarylsulfones, polybenzimidazole, polybutylene terephthalate, polycarbonates, polyester, polyester imides, polyether sulfones, polyetherimides, polyetherketones, polyetheretherketones, polyethylene terephthalate, polyimides, polymethacrylate, polyolefins (e.g., polyethylene, polypropylene), polyallomers, polyoxadiazole, polyparaxylene, polyphenylene oxides ("PPO"), modified PPOs, polystyrene, polysulfone, fluorine containing polymer such as polytetrafluoroethylene, polyurethane, polyvinyl acetate, polyvinyl alcohol, polyvinyl halides such as polyvinyl chloride, polyvinyl chloride-vinyl acetate copolymer, polyvinyl pyrrolidone, polyvinylidene chloride, specialty polymers, polystyrene, polycarbonate, polypropylene, acrylonitrite butadiene-styrene copolymer and others.

Examples of Electronically Addressable Floats

Figure 3A:
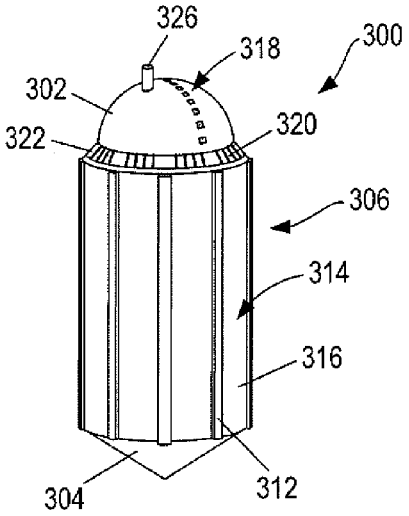
FIGS. 3A-3C show different views of an electronically addressable float.
Figure 3B:
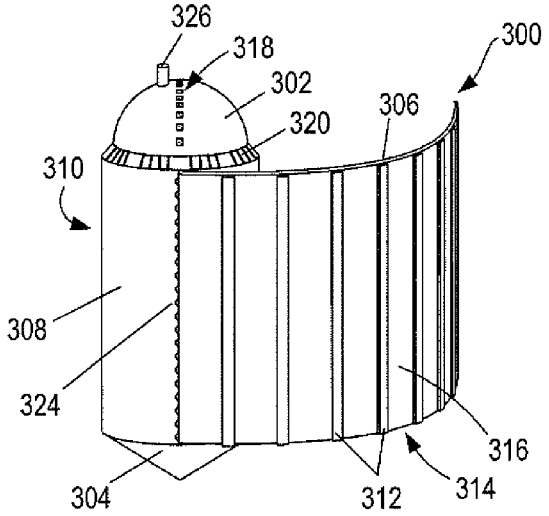
Figure 3C:
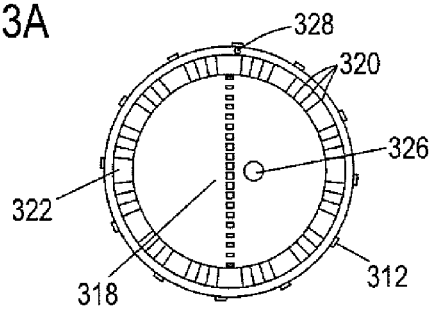

FIGS. 3A-3C show three different views of an electronically addressable float 300. In FIGS. 3A-3B, the float 300 has a dome-shaped end cap 302 and a cone-shaped end cap 304. FIG. 3B reveals that the float 300 also includes a thin, pliable, electronically addressable membrane 306 that wraps around a cylindrical main body portion 308 of a float core 310. The membrane 306 includes structural elements 312 that form channels 314 between the exterior membrane surface 316 and the inner wall of a tube, as described in greater detail below. FIGS. 3A-3C reveal that the float core 310 includes a series of electrodes 318 embedded in the outer surface of the end cap 302 and electrodes 320 distributed around angled annular surface 322. The float core 310 also includes a series of electrodes 324 partially occluded by the edge of the membrane 306. The electrodes 324 span the height of the main body 308. The float 300 also includes an alignment post 326 that protrudes from the end cap 302. The alignment post 326 is used to align the electrodes 318 and 322 with electrodes of an electric float connector described in greater detail below with reference to FIG. 11. The top view of FIG. 3C also reveals the end of a ground wire 328 that spans the height of and is embedded within the membrane 306.

Figure 4A:
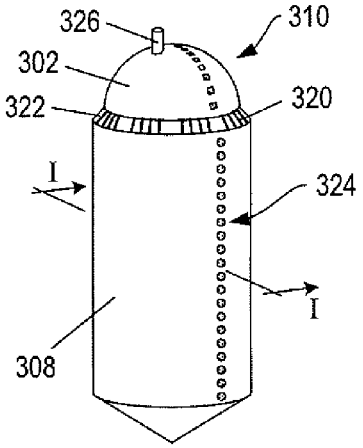
FIGS. 4A-4B show isometric and cross-sectional views, respectively, of a float core.
Figure 4B:
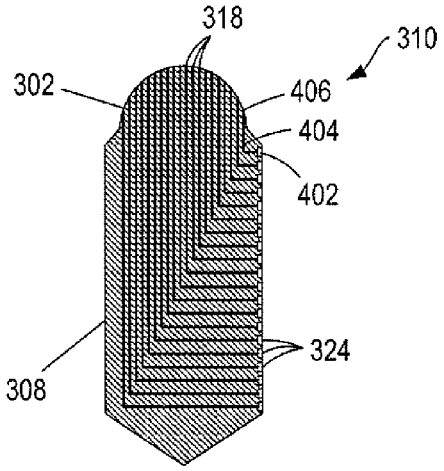

FIGS. 4A-4B show isometric and cross-sectional views, respectively, of the float core 310. In FIG. 4A, the membrane 306 shown partially removed in FIG. 3B is fully removed to reveal the series of electrodes 324 embedded within the main body 308. FIG. 4B shows a cross-sectional view of the float core 310 along a line I-I shown in FIG. 4A which reveals the interior of the float core 310. In the example of FIG. 4B, each electrode embedded in the main body 308 is connected by an L-shaped wire to an electrode embedded in the dome-shaped end cap 302. For example, an electrode 402 is embedded in the main body 308 and is connected by an L-shaped wire 404 to an electrode 406 in the dome-shaped end cap 302. The float core 310 can be composed of the materials described above or any other polymer, plastic or material that insulates the L-shaped wires to prevent cross talk. The float core 310 can be formed in two halves that when joined along opposing faces form the float core 310 shown in FIG. 4A. Each half can be formed in a mold with the electrodes and wires printed on a face of one of the halves as shown in FIG. 4B. The wires and electrodes can be copper, aluminum, platinum or any other suitable conductor. The two halves can be joined along the faces using a heat weld or a non-conductive adhesive to form the float core 310.

Figure 5:
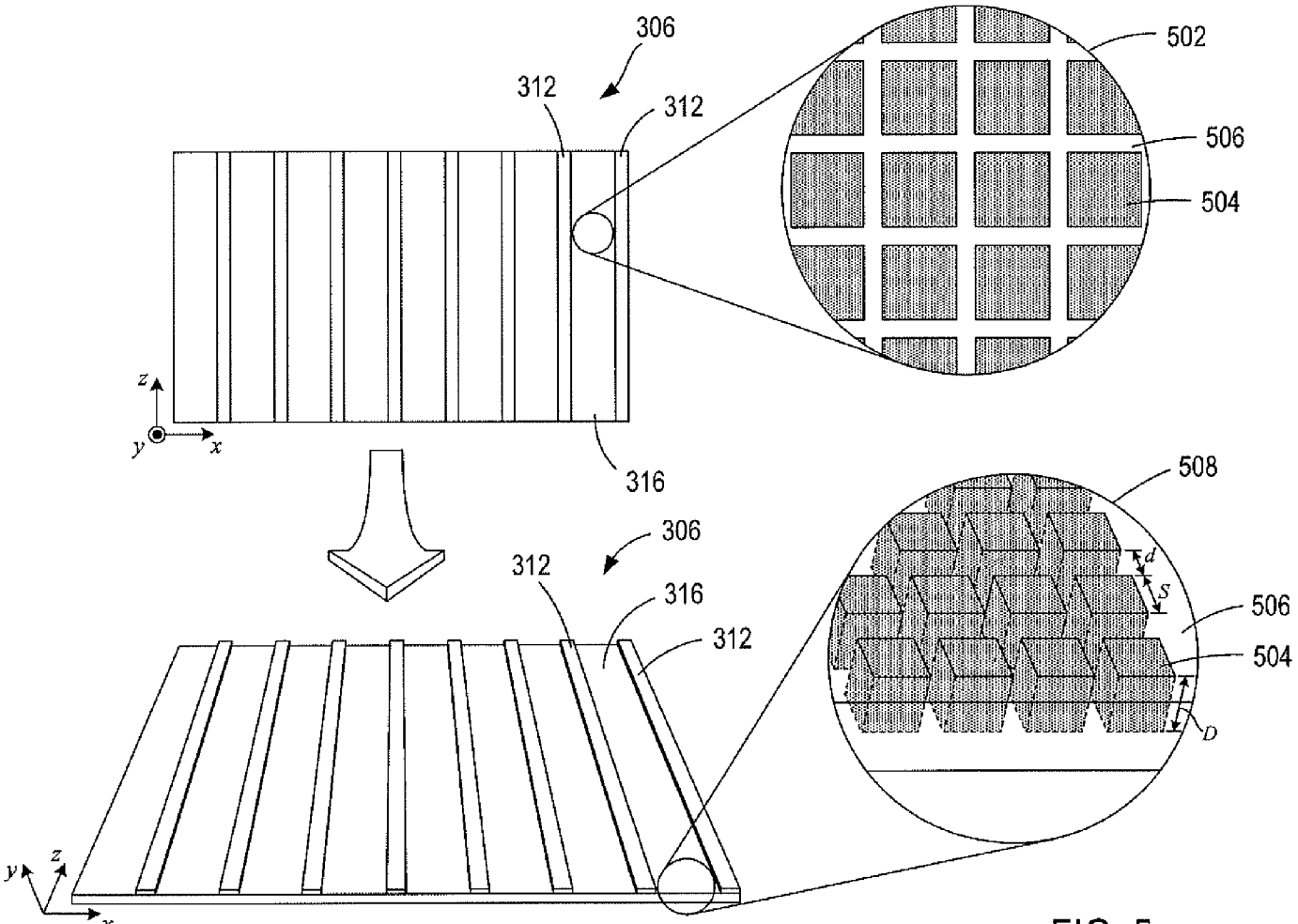
FIG. 5 shows different example views of an electronically addressable float membrane.

FIG. 5 shows different views of the electronically addressable membrane 306. FIG. 5 includes orthogonal Cartesian coordinate axes in order to describe the relative orientation of various components of the membrane 306. A magnified view 502 of the membrane surface 316 reveals that between each pair of structural elements 312 is a square lattice array of electrodes represented by shaded squares 504. The electrodes 504 are embedded within a non-conductor or semiconductor material 506. The external face of the electrodes 504 and the material 506 form a smooth continuous surface between the structural elements 312. FIG. 5 also shows a magnified view 508 of the membrane 316 angled to reveal the extent to which the electrodes 504 are embedded within the material 506. The electrodes 504 are square prisms with square face sides of length S and are separated by d in the xz-plane. Each electrode extends in the y-direction into the material 506 a distance D. The distance D is less than the thickness of the material 506. The electrodes 504 can be composed of copper, aluminum, platinum or another suitable conducting material, and the material 506 can be composed of a plastic, an insulating polymer, or a semiconductor.

Figure 6A:
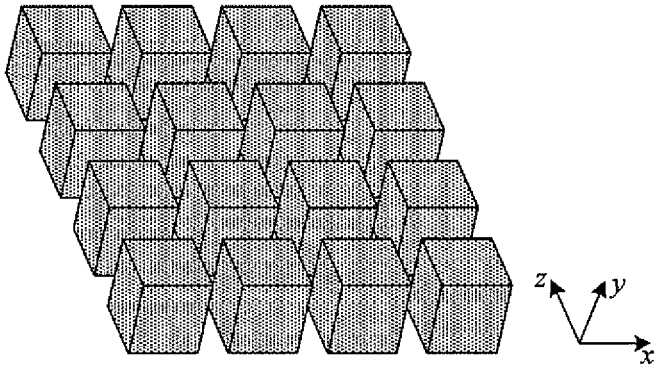
FIGS. 6A-6C show isometric views of components embedded within an electronically addressable float membrane.
Figure 6B:
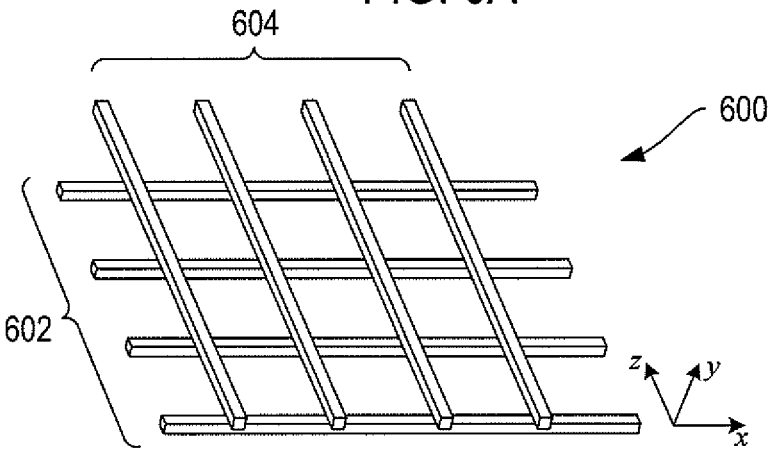
Figure 6C:
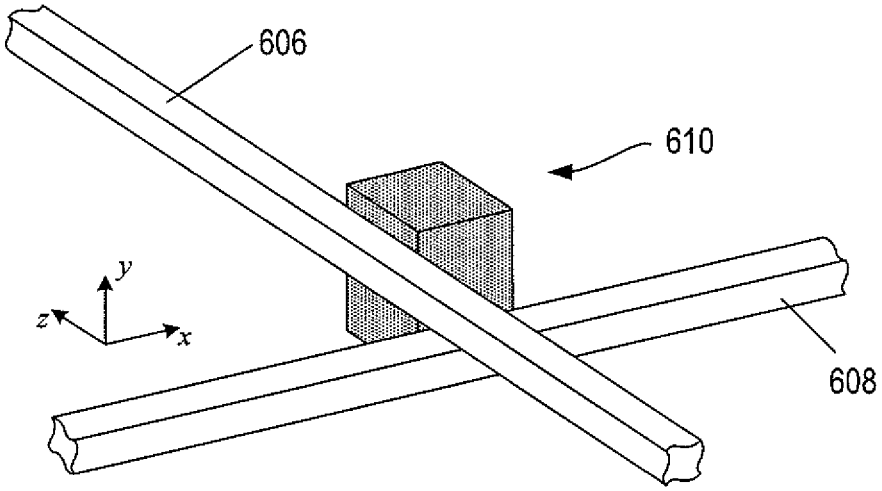

The membrane 306 also includes a wire crossbar that enables each electrode to be separately and electronically addressed. FIGS. 6A-6C show isometric views of components embedded within the membrane 306. FIG. 6A shows an array of sixteen separate electrodes. The electrodes are disposed within an insulating material as described above with reference to FIG. 5. FIG. 6B shows a wire crossbar 600 composed of a first layer of substantially parallel wires 602 overlain by a second layer of substantially parallel wires 604. The wires in the second layer 604 overlay but are not in contact with the wires in the first layer 602. As shown in FIG. 6B, the wires in the first layer 602 extend in the x-direction and the wires in the second layer 604 extend in the z-direction. Within the membrane 306, an electrode is located where each wire in the first layer overlays a wire in the second layer. For example, FIG. 6C shows a wire 606 of the second layer overlaying a wire 608 in the first layer. The wires 606 and 608 are in contact with an electrode 610. The electrode 610 is selectively addressed by applying appropriate signals to the wires 606 and 608. A signal can be alternating or direct current or voltage. For example, appropriate voltages applied to the wires 606 and 608 create a current that runs through the electrode 610.

Figure 7:
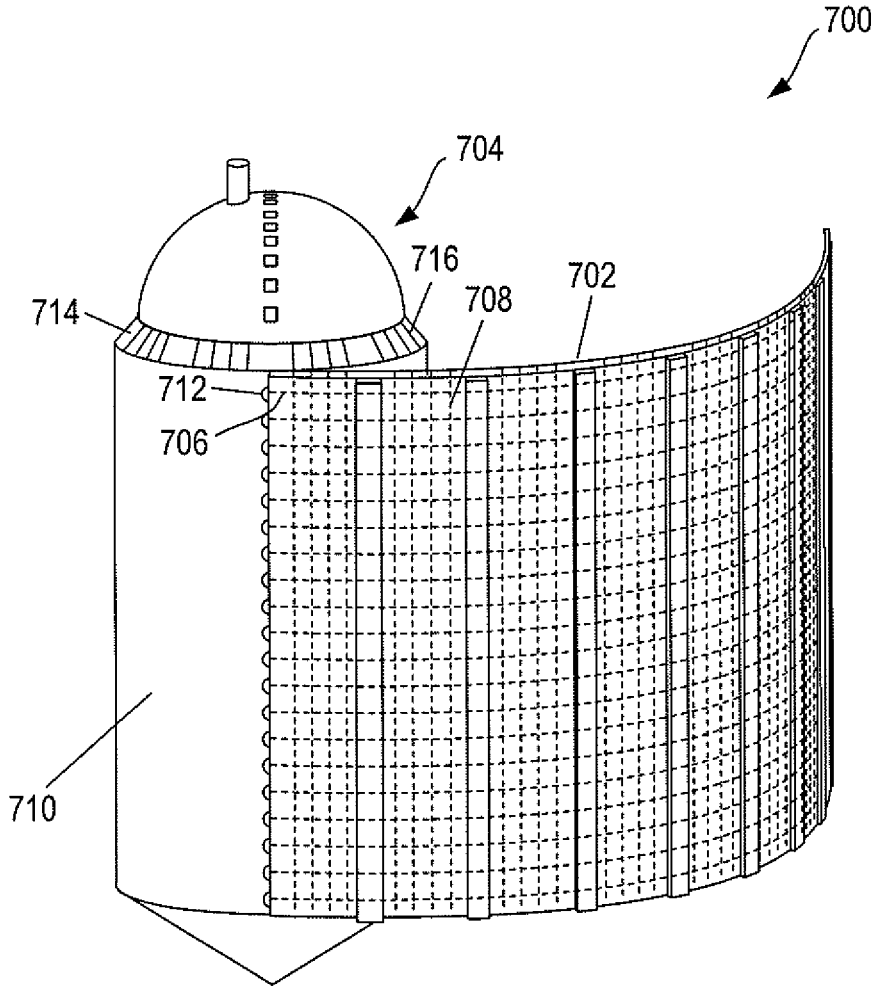
FIG. 7 shows an isometric view an electronically addressable membrane partially attached to a float core.

The membrane 306 can be fabricated using microelectronic technology. For example, the membrane 306 can be fabricated using microlithography, micromachining or printed circuit board techniques. The membrane is then wrapped around a main body portion of a float core and can be attached to the main body with an adhesive. FIG. 7 shows an isometric view of a float 700 with an electronically addressable membrane 702 partially attached to a float core 704. Intersecting dashed lines represent the overlaying wires of a wire crossbar embedded within the membrane 702. For example, dashed line 706 represents a wire of a first set of substantially parallel wires embedded within the membrane 702 and dashed line 708 represents a wire of a second set of substantially parallel wires embedded with the membrane 702. The wires in the first set wrap around main body portion 710 of the float core 704 and are each connected at a first end to an electrode embedded in the main body 710 and are each connected at a second end to a ground wire not shown, such as the ground wire 328 shown in FIG. 3C. For example, the wire 706 is connected at a first to embedded electrode 712 and is connected at a second end to a ground wire. Each wire in the second set is connected to one of the wires embedded in angled surface 714. For example, when the membrane is wrapped around the main body 710, the wire 708 is connected to the electrode 716. Electrodes (not shown) are embedded within the membrane 702 where two overlying wires cross as shown in FIG. 6C.

Figure 8:
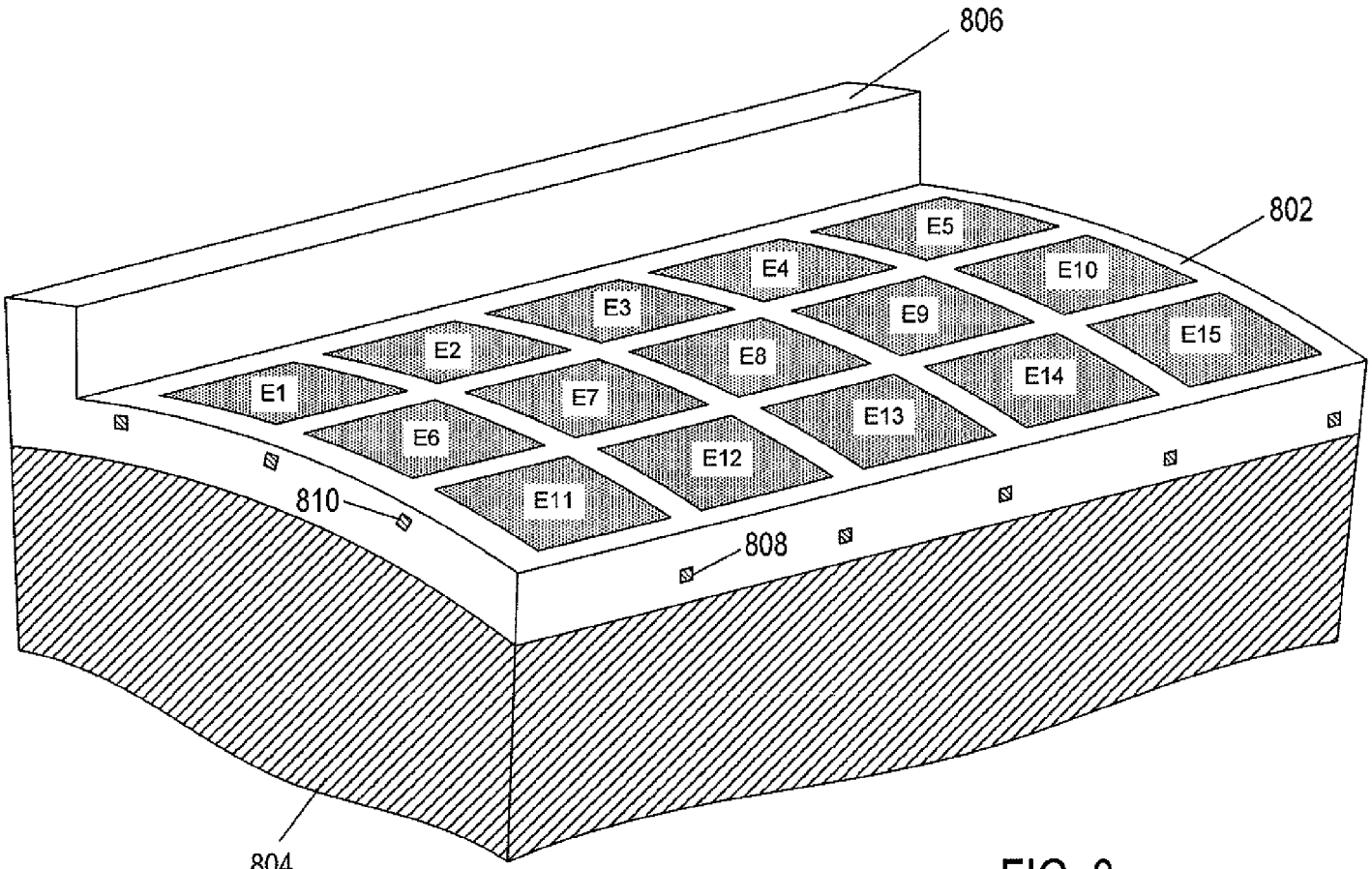
FIG. 8 shows an isometric view of a portion of an example electronically addressable float.

FIG. 8 shows an isometric view of a portion of an example electronically addressable float. In the example of FIG. 8, the membrane 802 is attached to a main body portion 804 of a float core. The membrane 802 includes a structural element 806. Fifteen electrodes identified as E1-E15 are embedded within the membrane 802. Each electrode is in contact with two overlaying wires, one wire from a set of substantially parallel wire that wrap around the main body 804 and one wire from a set of substantially parallel wires that approximately span the height of the main body 804. For example, the electrode E11 is in contact with an electrode 808 that wraps around the main body 804 and is in contact with a wire 810 that spans the height of the main body 804. The electrodes and outer surface of the membrane between structural elements can be machined so that the electrodes and the material between the electrodes from a smooth continuous surface.

In other embodiments, the electrodes can be coated within an insulating layer to prevent electrolysis due to an interaction of the electrodes with a fluid, which may contain positive and negative ions. The insulating layer can be omitted when the electrodes are composed of a material that does not chemically react with the fluid or the signals applied to the electrodes are high enough to make electrolysis negligible.

The electrodes are not limited to having square exposed surfaces and an electronic grid with a square lattice arrangement as described with reference to the examples above. The electrodes may also be rectangular prisms with rectangular exposed surfaces or hexagonal prisms with hexagonal exposed surfaces and the electronic grid can have a variety of different lattice arrangements including rhombic, rectangular or hexagonal lattice arrangements. For example, when the electrodes are hexagonal prisms, the electronic grid can have a hexagonal lattice arrangement.

Figure 9:
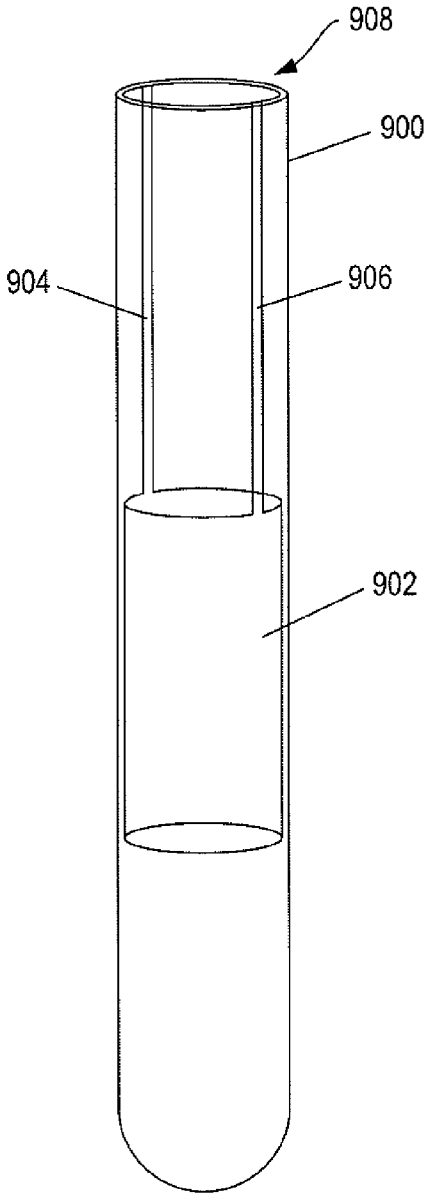
FIG. 9 shows an isometric view of a tube to be used with an electronically addressable float.

Using Tube and Electronically Addressable Float Systems to Trap and Isolate Target Materials of a Suspension FIG. 9 shows an isometric view of a tube 900 for use with an electronically addressable float. The tube 900 is similar to the tube 102 described above with reference to FIG. 1, but the tube 900 includes a cylindrical-shaped electrode 902 disposed on the inner surface of the tube. The tube 900 also includes two electrical leads 904 and 906 disposed on the inner surface of the tube. As shown in FIG. 9, the leads 904 and 906 extend from the electrode 902 to an open end 908. The electrode 902 can be composed of a transparent, conductive material, such as indium tin oxide ("ITO"), in order to allow the interior of the tube to be visually inspected through the electrode 902. The leads 904 and 906 can be composed of a transparent conductive material, such as ITO, or a non-transparent conductive material, such as copper, aluminum, platinum, or any other suitable conductor. The electrode 902 and leads 904 and 906 can be coated with an insulating layer to protect the electrode and leads from electrolysis.

Figure 10A:
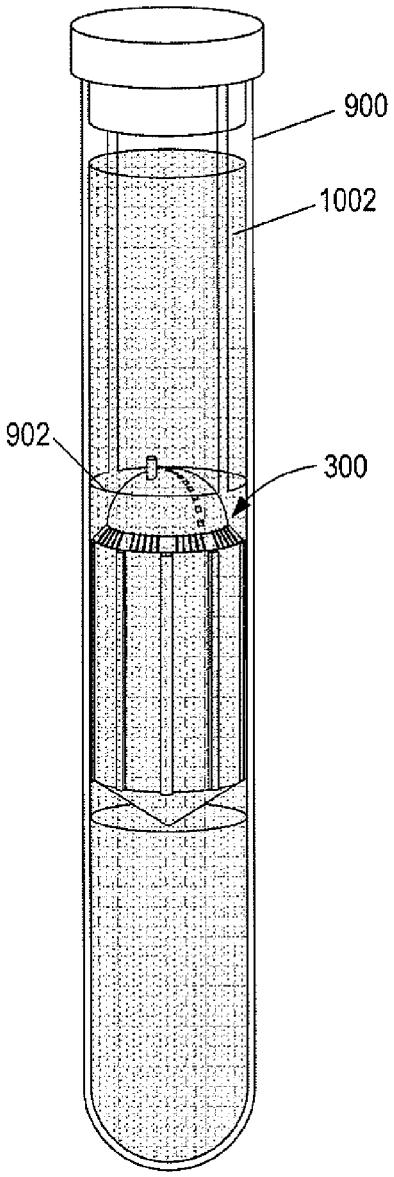
FIGS. 10A-10D show use an electronically addressable float inserted into a tube with a suspension.
Figure 10B:
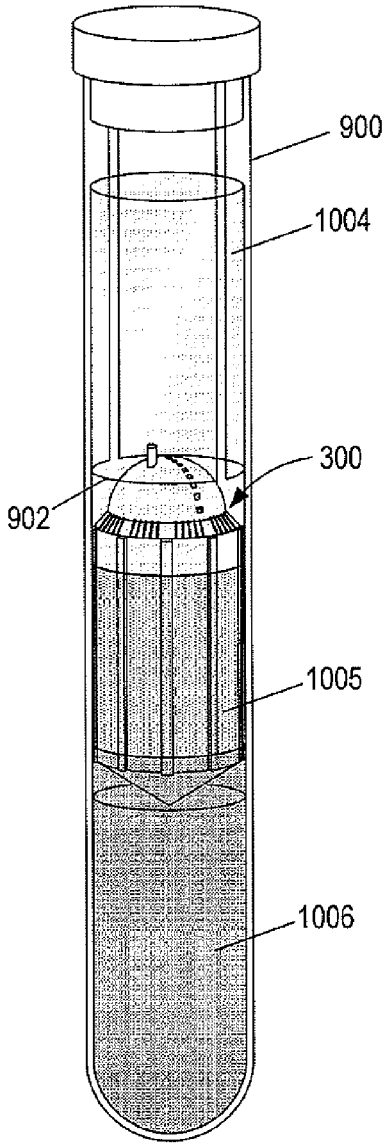
Figure 10C:
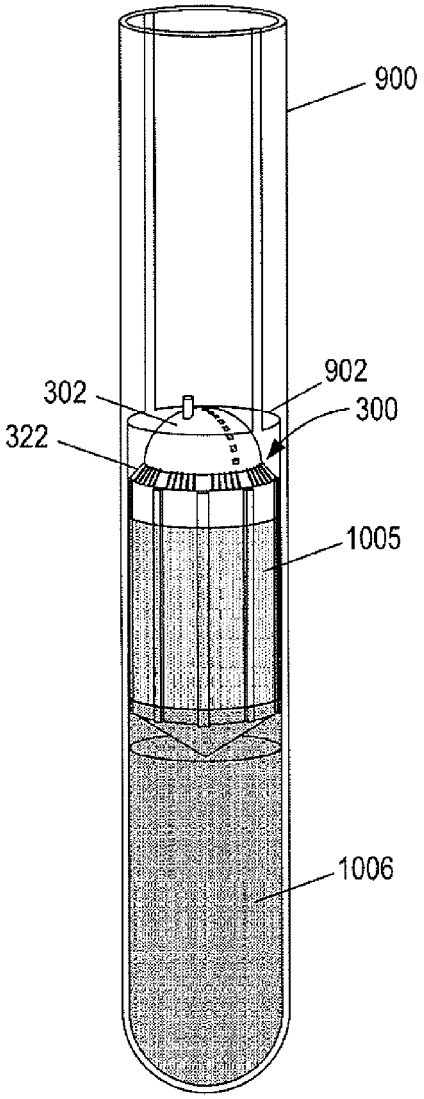
Figure 10D:
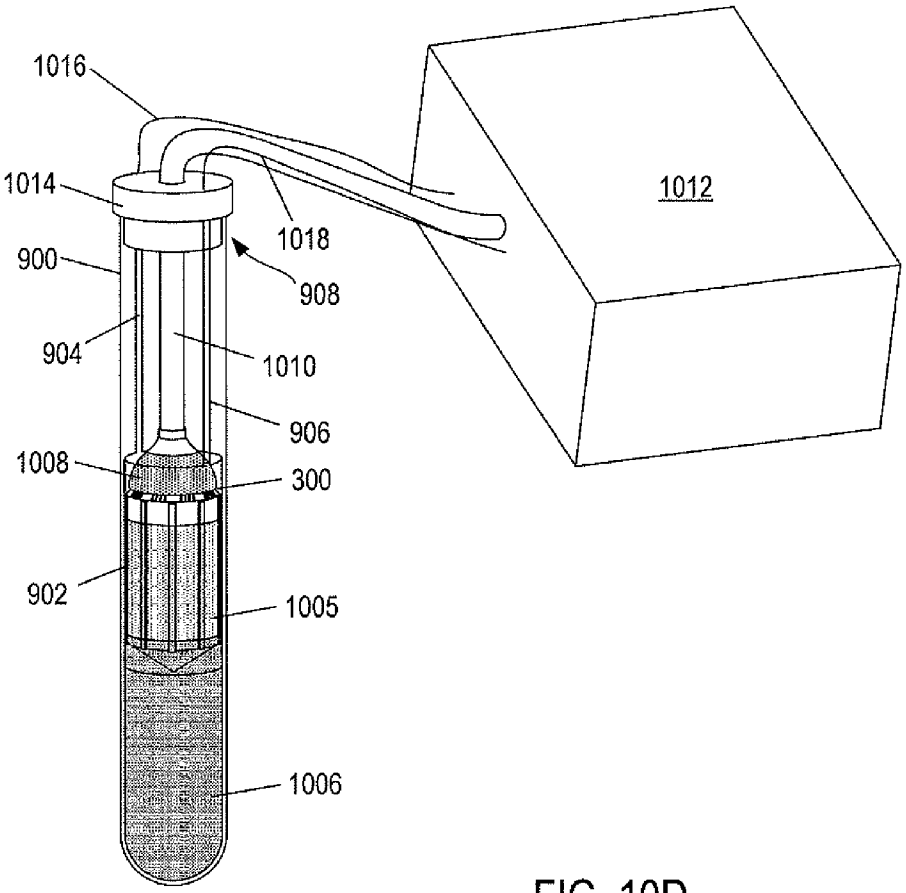

FIGS. 10A-10D show use of the tube 900 and electronically addressable float 300 as a system with a suspension containing a target material. In the example of FIG. 10A, the electronically addressable float 300 is disposed within the tube 900 along with a suspension 1002 that contains a target material. The float 300 has a density that approximately matches the density of the target material. When the tube 900, float 300 and suspension 1002 are centrifuged together for a period of time, the suspension materials separate into layers along the axial length of the tube according to each layers associated density with higher density materials settling beneath lower density materials. In the example of FIG. 10B, centrifugation has caused the suspension 1002 to separate into three layers 1004-1006 in which the layer 1005 contains the target material. Because the float 300 has a density that approximately matches the density of the target material, the float 300 is positioned at approximately the same level as the layer 1005 and expands the axial length of the layer 1005 between the main body of the float 300 and the inner surface of the tube. In particular, target material particles in the layer 1005 are located within the channels between the main body of the float 300 and the inner wall of the tube 900. In order to use the electronically addressable features of the float 300, the layers above the float 300 are removed to expose the electrodes. In the example of FIG. 10C, the lowest density layer 1004 is removed to expose the electrodes embedded in the end cap 302 and the electrodes distributed around the angled surface 322. The layers can be removed with a pipette or the layers can be poured off. A jet of air may also be applied to drive off extraneous materials, debris or fluid remaining on the end cap 302 and the angled surface 322. In the example of FIG. 10D, an electric float connector 1008 is inserted through the open end 908 of the tube 900 and placed on the end cap 302 of the float 300. The connector 1008 is attached to a first end of an electrical cable 1010 that is connected at a second end to an electronic system control 1012. The cable 1010 passes through a hole in a cap 1014 that is inserted into the open end 908. Electrical wires 1016 and 1018 are also connected to the control 1012 and to the leads 904 and 906, respectively, through the cap 1014. The control 1012 selectively applies signals to the individual crossbar wires of the membrane 306 via the connector 1008 and may apply a signal to the electrode 902 in order to create electrostatic potential cages that trap, and can be used to move, target material particles of the layer 1005 as described in greater detail below.

Figure 11:
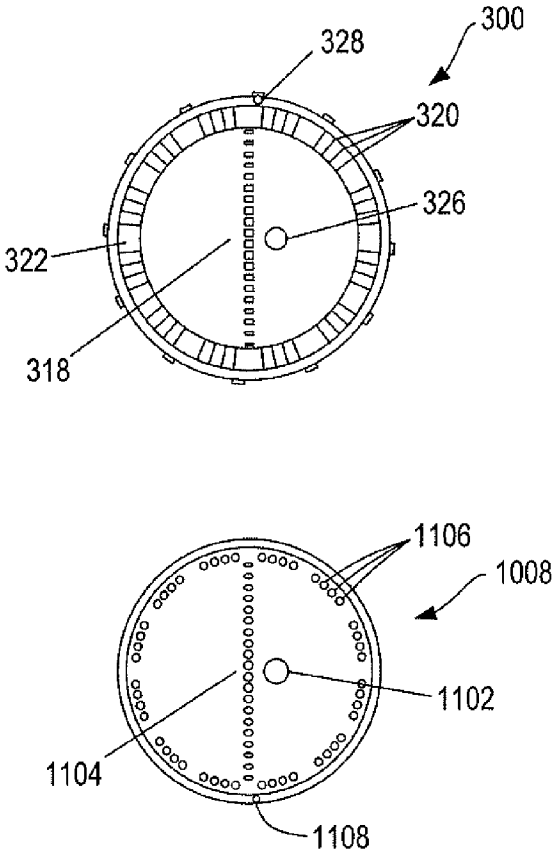
FIG. 11 shows a top view of an electronically addressable float end cap and an inside view of an electric float connector.

FIG. 11 shows a top view of the float 300 end cap 302 described above with reference to FIG. 3C and a corresponding inside view of the connector 1008 shown in FIG. 10D. The inside view of the connector 1008 reveals an aperture 1102, a series of electrodes 1104, and electrodes 1106 distributed around the inside of the connector 1008, and a ground electrode 1108. When the connector 1008 is placed on the float 300 as shown in FIG. 10D, the alignment post 326 is inserted into the aperture 1102, the electrodes 1104 are aligned with and make contact with the electrodes 318, the electrodes 1106 are aligned with and make contact with the electrodes 320, and the ground electrode 1108 is in contact with the end of the ground wire 328. In other embodiments, the alignment post 326 can composed of a metal and the aperture 1102 can include a magnet to secure the connector to the end cap 302.

Figure 12:
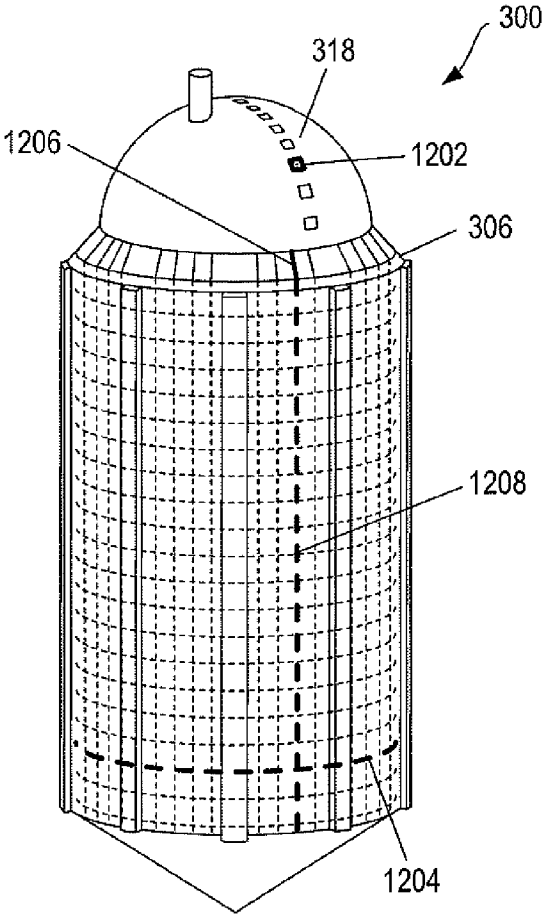
FIG. 12 shows an isometric view of a float with a wire crossbar embedded in a membrane wrapped around the float.

FIG. 12 shows an isometric view of the float 300 with the wire crossbar embedded in the membrane 306 identified by dashed lines. A signal applied to an electrode 1202 of the electrodes 318 places a signal on a wire 1204 that wraps around the main body of the float 300, and a signal applied to the electrode 1206 places the signal on the wire 1208. The signals are applied through corresponding electrodes in the connector 1008, which is not shown in FIG. 12. An electrode (not shown) embedded in the membrane 306 and in contact with the wires 1204 and 1208 where the wires overlay one another creates a voltage or current on the electrode. Excess current is carried away by the ground wire 328 shown in FIG. 11.

The signals applied to the wires of the membrane can be alternating or direct. With alternating current of voltage, the movement of electric charge periodically reverses direction. On the other hand, with direct current or voltage, the flow of electric charge is only in one direction. Appropriate signals applied to the electrodes embedded in the membrane of a float and signals applied to the electrode of the tube create non-uniform electric fields between the electrodes of the membrane and the electrode of the tube. The forces exerted by the electric fields can be selectively created to trap, move and manipulate polarizable micro-particles, such as the micro-scale target material particles of a suspension. For example, a suspension can be a biological suspension, such as whole blood, stool, semen, cerebrospinal fluid, nipple aspirate fluid, saliva, amniotic fluid, vaginal secretions, mucus membrane secretions, aqueous humor, vitreous humor, vomit, and any other physiological fluid or semi-solid. The particles of the target material can be cells, such as ova or circulating tumor cells, parasites, microorganisms, and inflammatory cells, which are polarizable when subjected to a non-uniform electric field. A non-uniform electric field applied to a dielectric particle to exert a force on the particle is a process called dielectrophoresis ("DEP"). A neutral particle subjected to a non-uniform electric field experiences a net force directed towards locations with increasing field intensities called positive dielectophoresis ("pDEP") or decreasing field intensities called negative dielectrophoresis ("nDEP"). The electrodes of the membrane and the tube induce potential cages in the spatial region above selected sites, within which single particles can be individually trapped, moved and manipulated.

Figure 13:
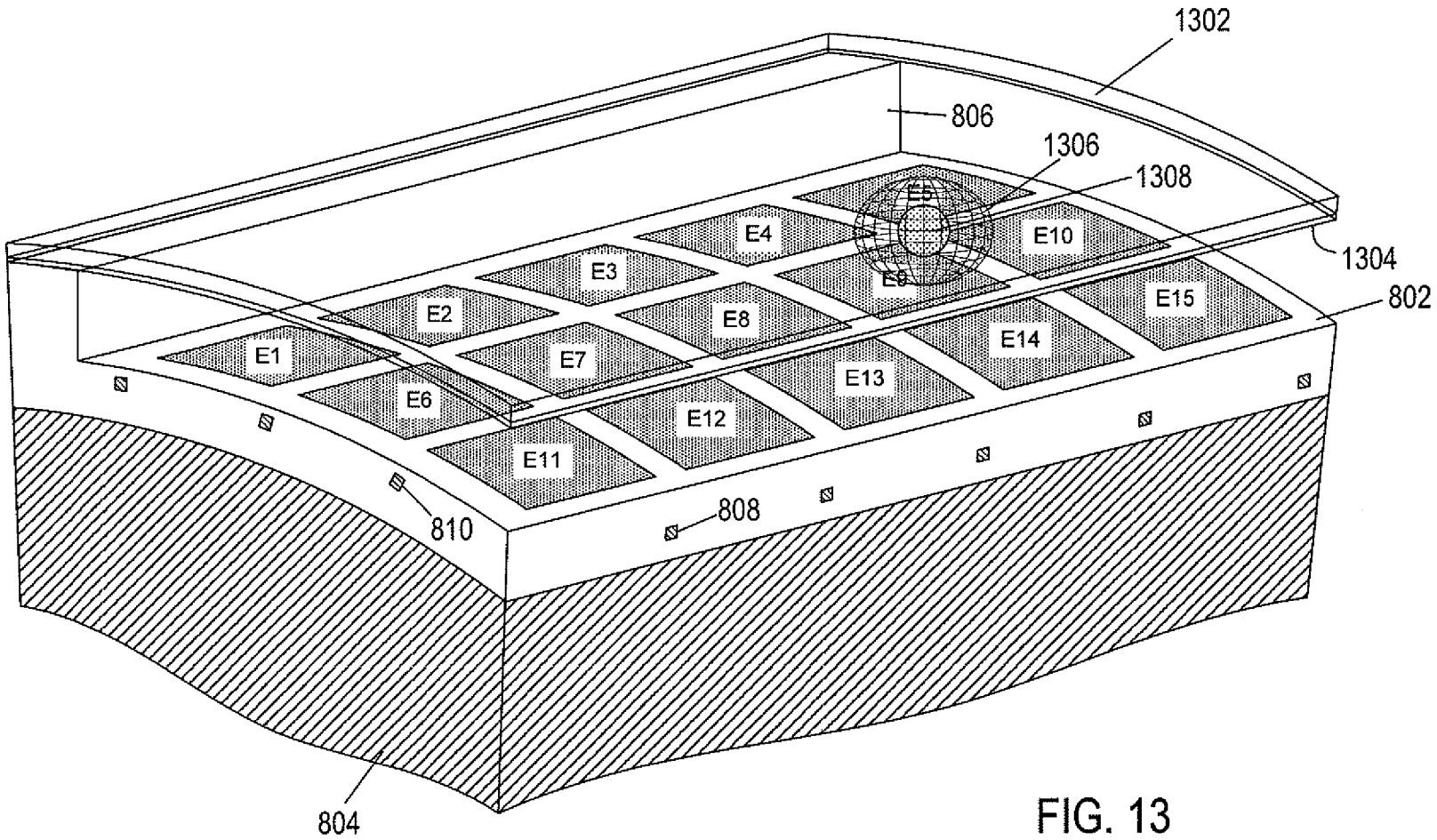
FIG. 13 shows an isometric view of a portion of an example electronically addressable float inserted into a tube.

FIG. 13 shows an isometric view of the portion of the example electronically addressable float shown in FIG. 8 inserted into a tube 1302. The inner surface of the tube 1302 surrounding the float is lined with a transparent electrode 1304. In the example of FIG. 13, a potential cage 1306 is represented by a wire frame that surrounds a particle 1308 of a target material located between the outer surface of the membrane and the inner wall of the tube. The potential cage 1306 traps the particle 1308 between the contract E9 and the electrode 1304 and can be created by generating appropriate voltages at the contract E9 and surround contracts E3-E8 and E10-15 given by:

$$V_{E\eta}=-V_E,$$

$$V_{E9}=V_E,$$

and $$V_M=-V_e,$$

where $\eta=1-8, 10-15$;

$V_E$ and $V_e$ represent voltage magnitudes;

$V_{E\eta}$ represents the voltages at the electrodes E1-E15; and $V_M$ represents the voltage at the electrode 1304.

For example, the magnitudes $V_E$ and $V_e$ can range from approximately −3.0V to approximately 3.0V.

Figure 14A:
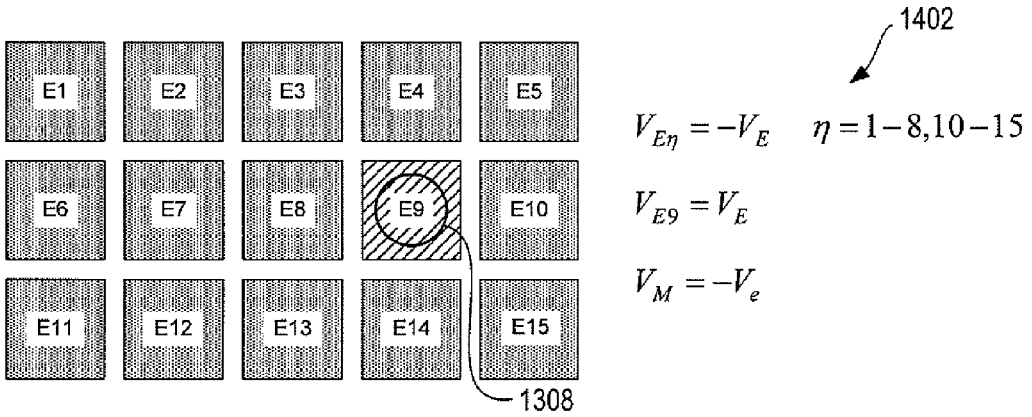
FIGS. 14A-14C show top views of electrodes of a float membrane.
Figure 14B:
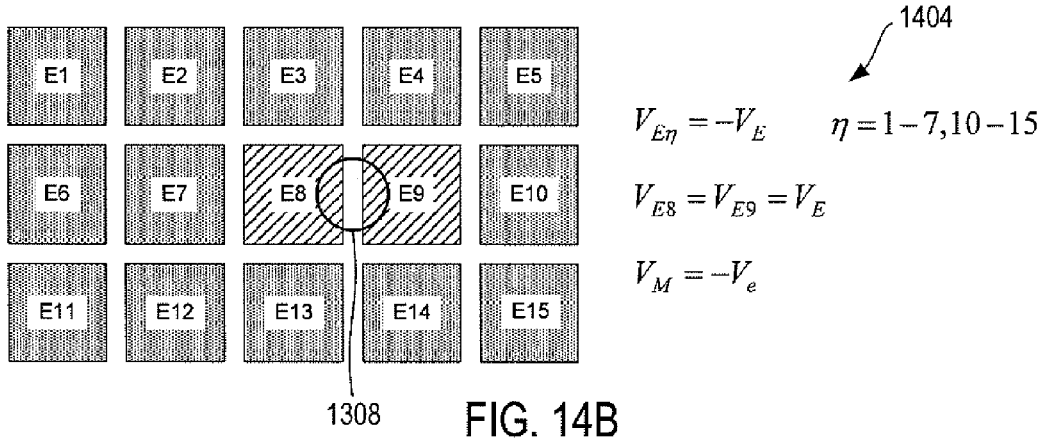
Figure 14C:
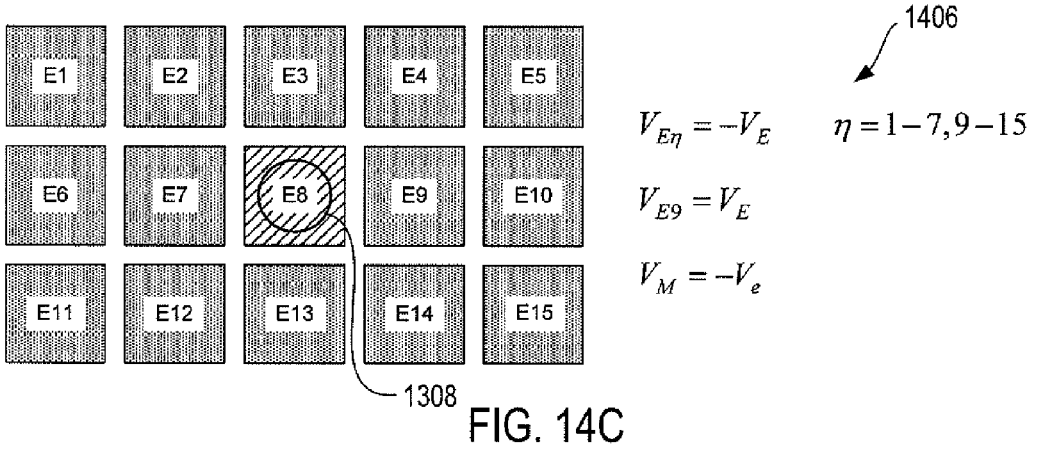

The particle 1308 can be moved by successively reversing polarities of the voltages at the embedded electrodes along a path the particle is desired to travel. FIGS. 14A-14C show top views of the electrodes E1-E15 and represent an example of moving the particle 1308 from above the electrode E9 to above the electrode E8. In FIG. 14A, the particle 1308 is initially trapped above the electrode E9 with the voltages 1402 applied to the electrodes E1-E15 as described above with reference to FIG. 13. In FIG. 14B, the particle 1308 is moved from the electrode E9 to a position in which the particle 1308 overlaps the electrodes E8 and E9 by reversing the polarity of the voltage at the electrode E8 while maintaining the voltages at the electrodes E1-E7 and E9-E15 as represented by the voltages 1404. In FIG. 14C, the particle 1308 is moved to the electrode E8 by reversing the polarity of the voltage at the electrode E9 while maintaining the voltages at the electrodes E1-E8 and E10-E15 as represented by the voltages 1406. The particle 1308 can be moved along the surface of the float to a desired locate by successively reversing the polarities of neighboring electrodes as just described.

Figure 15:
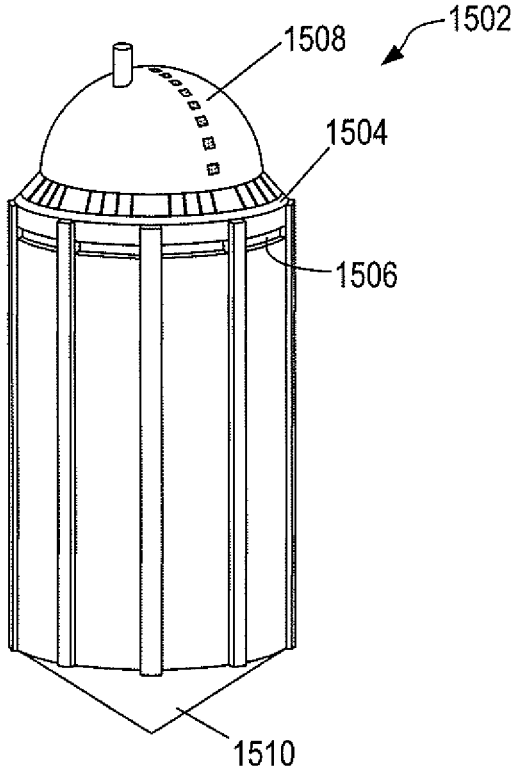
FIG. 15 shows an isometric view of an example electronically addressable float with repositories.

In other embodiments, the membrane can include one or more repositories so that the individual target material particles can be collected and removed from the tube. FIG. 15 shows an isometric view of an example electronically addressable float 1502. The float 1502 is similar to the float 300 except the float 1504 has a membrane 1504 that includes a series of repositories 1506 located at the end of each channel near dome-shaped end cap 1508. In other embodiments, the repositories can be located anywhere along the channels. For example, the repositories can also be located near the midpoint of the membrane 1504 or the repositories can be located near cone-shaped end cap 1510.

Figure 16:
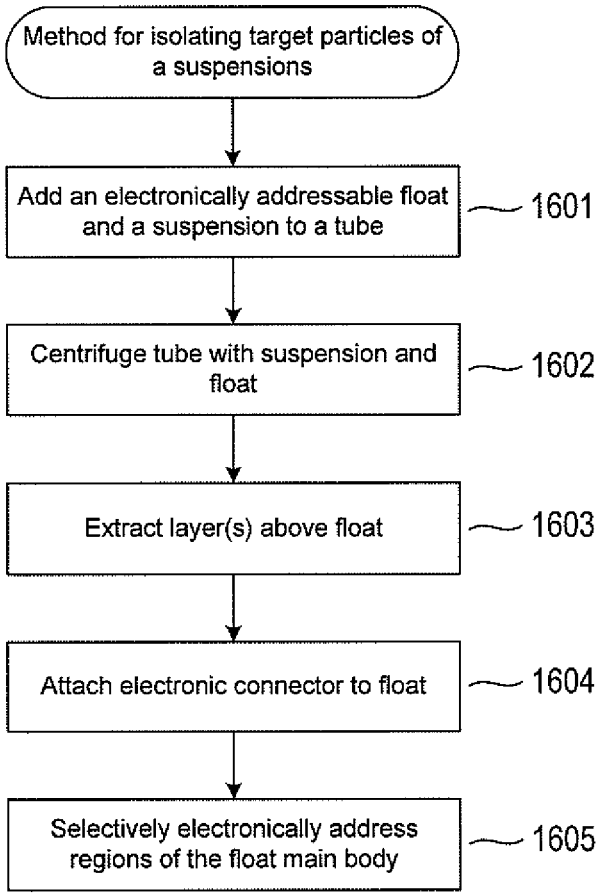
FIG. 16 shows a flow diagram of a method for isolating target material particles of a suspension.

FIG. 16 shows a flow diagram associated with a method for isolating target material particles of a suspension. In block 1601, an electronically addressable float and a suspension suspected of containing a target material is added to a tube, as described above with reference to FIG. 10A. The float has a density that substantially matches the density of the target material. In block 1602, the tube with the suspension and float are centrifuged together to axially separate the material components of the suspension along the tube such that the target material is spread between the main body of the float and the inner wall of the tube, as described above with reference to FIG. 10B. In block 1603, one or more layers of material above the float are removed, as described above with reference to FIG. 10C. The layer material located between the float and the inner wall of the tube is then analyzed to determine the location of specific target material particles. Once these target particles are located, the particles can be trapped or moved away from and isolated from the rest of the materials of the suspension. In block 1604, the electric connector described above with reference to FIG. 11 is attached to the float as describe above with reference to FIG. 10D. In block 1605, regions of the float membrane are electronically addressed as described above with reference to FIGS. 12-14 to trap the target particles and/or move the target particles. When the membrane is configured with a repository, the target particles can be moved to a repository for collection. Once collected, the target particles may be analyzed using any appropriate analysis method or technique. For example, with biological samples, the collected target particles may be cells that are analyzed using intracellular protein analysis by immunofluorescence ("IF"), fluorescent in situ hybridization ("FISH"—a tool for analyzing gene copy number), or branched DNA analysis ("bDNA"—a tool for analyzing mRNA expression levels). A portion of the intracellular proteins can be stained using cytokeratin ("CK"), actin, Arp2/3, coronin, dystrophin, FtsZ, myosin, spectrin, tubulin, collagen, cathepsin D, ALDH, TWIST1, PBGD, and MAGE.

It should be understood that the method and system described and discussed herein may be used with any appropriate suspension or biological sample, such as blood, stool, semen, cerebrospinal fluid, nipple aspirate fluid, saliva, amniotic fluid, vaginal secretions, mucus membrane secretions, aqueous humor, vitreous humor, vomit, and any other physiological fluid or semi-solid. The foregoing description, for purposes of explanation, used specific nomenclature to provide a thorough understanding of the disclosure. However, it will be apparent to one skilled in the art that the specific details are not required in order to practice the systems and methods described herein. For example, an electronically addressable membrane is not limited to the splines a described above. In other embodiments, an electronically addressable membrane can include any one of a variety of different structural elements, such as the structural elements shown in FIG. 2. The foregoing descriptions of specific embodiments are presented by way of examples for purposes of illustration and description. They are not intended to be exhaustive of or to limit this disclosure to the precise forms described. Many modifications and variations are possible in view of the above teachings. The embodiments are shown and described in order to best explain the principles of this disclosure and practical applications, to thereby enable others skilled in the art to best utilize this disclosure and various embodiments with various modifications as are suited to the particular use contemplated. It is intended that the scope of this disclosure be defined by the following claims and their equivalents:

The invention claimed is:

1. A system for analyzing a target material of a suspension, the system comprising:

a tube having an electrode disposed on the inner surface of the tube; and an electronically addressable float to be added to the tube, wherein the float includes one or more arrays of electrodes that can be independently addressed to create non-uniform electric fields between the electrodes of the float and the electrode of the tube to trap and manipulate particles of the target material.

2. The system of claim 1, wherein the float further comprises:

a float core including a first set of electrodes embedded in an end cap, a second set of electrodes embedded in a main body portion of the float core, and a third set of electrodes distributed around the end cap; and an electronically addressable membrane that wraps around the main body and includes the one or more arrays of electrodes embedded within the membrane, each electrode electronically connected to one electrode in the end cap and one electrode distributed around the end cap.

3. The system of claim 2, wherein the float core further comprises a set of internal wires, wherein each internal wire connects an electrode embedded in the end cap with an electrode embedded in the main body.

4. The system of claim 2, wherein the membrane further comprises a first set of substantially parallel wires embedded within the membrane; and a second set of substantially parallel wires that overlays the first set of wires and are embedded with the membrane, wherein each electrode of the one or more arrays of electrodes is in contact with a wire from the first set and a wire from the second set, and each wire in the first set is connected at one end to an electrode in the main body and each wire in the second set is connected at one end to an electrode distributed around the end cap.

5. The system of claim 4, wherein the membrane includes a ground wire connected to each wire in the first set.

6. The system of claim 2, wherein membrane includes one or more repositories to receive the target material particles.

7. The system of claim 1, wherein the electrode disposed on the inner surface of the tube is cylindrical.

8. The system of claim 1, wherein the electrode disposed on the inner surface of the tube is transparent.

9. The system of claim 1, wherein the one or more electrodes are embedded within an insulating material to form a smooth continuous surface.

10. The system of claim 1, wherein the float further comprises an insulating layer that coats to the electrodes to prevent electrolysis.

11. An electronically addressable float comprising:

a float core including a first set of electrodes embedded in an end cap, a second set of electrodes embedded in a main body portion of the float core, and a third set of electrodes distributed around the end cap; and an electronically addressable membrane that wraps around the main body and includes one or more arrays of electrodes embedded within the membrane, each electrode electronically connected to one electrode in the end cap and one electrode distributed around the end cap.

12. The system of claim 11, wherein the float core further comprises a set of internal wires, wherein each internal wire connects an electrode embedded in the end cap with an electrode embedded in the main body.

13. The system of claim 11, wherein the membrane further comprises a first set of substantially parallel wires embedded within the membrane; and a second set of substantially parallel wires that overlays the first set of wires and are embedded with the membrane, wherein each electrode of the one or more arrays of electrodes is in contact with a wire from the first set and a wire from the second set, and each wire in the first set is connected at one end to an electrode in the main body and each wire in the second set is connected at one end to an electrode distributed around the end cap.

14. The system of claim 13, wherein the membrane includes a ground wire connected to each wire in the first set.

15. The system of claim 11, wherein the membrane includes one or more repositories to receive the target material particles.

16. The system of claim 11, wherein the float further comprises an insulating layer that coats to the electrodes to prevent electrolysis.

17. A method for isolating particles of a target material of a suspension, the method comprising:

introducing an electronically addressable float to a tube that contains the suspension, wherein the float includes one or more arrays of electrodes;

centrifuging the tube with the suspension and the float to separate the suspension materials into layers along the tube so that a layer containing the target material is located between the float and the tube;

extracting layers of suspension material and fluid from above the float; and selectively addressing the electrodes to create non-uniform electric fields between the float and the tube, wherein the non-uniform electric fields create potential cages to isolate the particles.

18. The method of claim 17, wherein the float further comprises:

a float core including a first set of electrodes embedded in an end cap, a second set of electrodes embedded in a main body portion of the float core, and a third set of electrodes distributed around the end cap, and an electronically addressable membrane that wraps around the main body and includes the one or more arrays of electrodes embedded within the membrane, each electrode electronically connected to one electrode in the end cap and one electrode distributed around the end cap.

19. The method of claim 17, wherein selectively addressing the electrodes to create non-uniform electric fields between the float and the tube further comprising trapping the particles for analysis through the tube wall.

20. The method of claim 17, wherein selectively addressing the electrodes to create non-uniform electric fields between the float and the tube further comprising moving the particles to a repository on the float for collection and removal.

* * * * *